US006528729B1

(12) United States Patent
Kamata

(10) Patent No.: US 6,528,729 B1
(45) Date of Patent: Mar. 4, 2003

(54) FLEXIBLE CONDUCTOR OF HIGH STRENGTH AND LIGHT WEIGHT

(75) Inventor: Takeshi Kamata, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/666,794

(22) Filed: Sep. 21, 2000

(30) Foreign Application Priority Data

Sep. 30, 1999 (JP) ..... 11-279688

(51) Int. Cl.[7] ..... H01B 7/00
(52) U.S. Cl. ..... 174/113 R
(58) Field of Search ..... 174/36, 110, 113 R, 174/113 C, 116, 102 P, 128.1

(56) References Cited

U.S. PATENT DOCUMENTS

| | | | | | |
|---|---|---|---|---|---|
| 3,647,939 | A | * | 3/1972 | Schoerner | 174/128 |
| 3,767,842 | A | * | 10/1973 | Bronca et al. | 174/125.1 |
| 3,980,808 | A | * | 9/1976 | Kikuchi et al. | 174/102 E |
| 4,094,060 | A | * | 6/1978 | Madsen et al. | 148/668 |
| 4,449,012 | A | * | 5/1984 | Voser | 174/70 A |
| 4,611,390 | A | * | 9/1986 | Tanaka et al. | 29/599 |
| 4,634,805 | A | * | 1/1987 | Orban | 174/128.1 |
| 4,659,007 | A | * | 4/1987 | Onishi et al. | 228/156 |
| 4,659,174 | A | * | 4/1987 | Ditscheid et al. | 350/96.23 |
| 4,956,039 | A | * | 9/1990 | Olesen et al. | 156/180 |
| 5,024,902 | A | * | 6/1991 | Suganuma et al. | 428/361 |
| 5,130,193 | A | * | 7/1992 | Ikeda | 428/365 |
| 5,159,157 | A | * | 10/1992 | Diegmann | 174/113 C |
| 5,198,621 | A | * | 3/1993 | Kojima | 174/128.1 |
| 5,414,216 | A | * | 5/1995 | Swift et al. | 174/124 R |
| 5,460,883 | A | * | 10/1995 | Barber, Jr. et al. | 428/370 |
| 5,727,357 | A | * | 3/1998 | Arumugasaamy et al. | 52/740.1 |
| 5,929,385 | A | * | 7/1999 | Sugimoto et al. | 174/125.1 |
| 6,015,953 | A | * | 1/2000 | Tosaka et al. | 174/79 |
| 6,174,595 | B1 | * | 1/2001 | Sanders | 428/295.4 |
| 6,199,266 | B1 | * | 3/2001 | Meserve | 174/125.1 |
| 6,245,425 | B1 | * | 7/2001 | McCollough et al. | 428/379 |
| 6,305,070 | B1 | * | 10/2001 | Masur et al. | 29/599 |

FOREIGN PATENT DOCUMENTS

| | | | | |
|---|---|---|---|---|
| JP | 52-60093 | | 5/1977 | H01L/39/12 |
| JP | 5-174645 | | 7/1993 | H01B/13/00 |
| JP | 6-5130 | | 1/1994 | H01B/12/10 |
| JP | 6-119830 | | 4/1994 | H01B/12/08 |
| JP | 7-249328 | | 9/1995 | H01B/13/00 |
| JP | 8-109422 | | 4/1996 | C22C/1/05 |
| JP | 8-124426 | | 5/1996 | H01B/7/00 |
| JP | 9-105086 | A * | 4/1997 | D07B/5/00 |
| WO | WO 95/27991 | A * | 10/1995 | H01B/12/00 |
| WO | WO 98/13859 | A * | 4/1998 | |

OTHER PUBLICATIONS

Patent Abstract of Japan 08109422 Apr. 30, 1996.
Patent Abstract of Japan 08124426 May 17, 1996.

* cited by examiner

*Primary Examiner*—Dean A. Reichard
*Assistant Examiner*—William H. Mayo, III
(74) *Attorney, Agent, or Firm*—Sughrue Mion, PLLC

(57) ABSTRACT

A flexible conductor 1 of high strength and light weight, at the center of the conductor, a core material composed of a plurality of twisted reinforcing fibers 2, and a metal matrix 3 therearound.

6 Claims, 1 Drawing Sheet

FLEXIBLE CONDUCTOR OF HIGH STRENGTH AND LIGHT WEIGHT

BACKGROUND OF INVENTION

1. Field of Invention

The present invention relates to a flexible conductor of high strength and light weight available to various kinds of electric wires such as trolley lines, overhead power lines, electric wires for wire harness and others.

2. Related Art

Conventionally, for purposes of imparting high tensile strength to conductors used to trolley lines, overhead power lines, electric wires for wire harness and others, for example as shown in FIGS. 2(*a*) and 2(*b*) such a conductor 13 has been employed where a plurality of reinforcing fibers 10 made of carbon fibers are encircled with a metal matrix 11 dispersed with ceramic particles, and if required, further furnished with a coating layer 12 on the outer circumference of the metal matrix. However, since in such a conductor 13, each of the reinforcing fibers 10 is encircled with the metal matrix, the reinforcing fiber 10 is limited in serving performance, and in particular if the reinforcing fiber 10 occupies about 50% or more of the whole of the electric wire (volume ratio), flexural rigidity is too strong as a whole of the conductor and handling faculty is inferior.

For easily bending the conductor 13, the thickness of the metal matrix 11 is reduced to make the whole of the conductor thin, but in turn the reinforcing fiber 10 is exposed in the surface of the metal matrix 11, and the conductor 13 is difficult to make circular and a measure is necessary for die-processing. The coating layer 12 is thickened to correct the conductor 13 to be circular, inviting results opposite to aiming at reduction of the diameter.

As mentioned above, the conventional conductor supporting the reinforcing fiber therein is limited in improvement of tensile strength owing to restriction of the volume ratio of the reinforcing fiber, and is not suited to reduction of the diameter, either.

SUMMARY OF INVENTION

It is accordingly an object of the invention to provide a conductor having excellent tensile strength and bending characteristic and suited to reduction of the diameter thereof.

For accomplishing the object, the invention is to offer a flexible conductor of high strength and light weight (called briefly as "conductor" hereafter) which is provided by disposing at the center of the conductor a core material includes a plurality of twisted reinforcing fibers, and encircling a metal matrix therearound.

DETAILED DESCRIPTION OF PREFERRED EMBODIMENTS

Figure 1A:
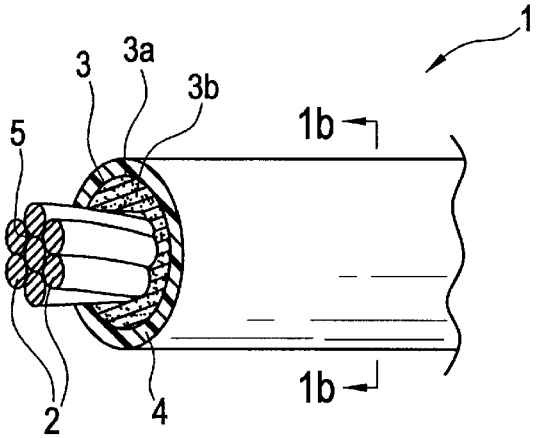
FIG. 1(A) is a perspective view, partially broken, showing the flexible conductor of high strength and light weight of the invention.

The invention will be explained in detail with reference to the drawing.

Figure 1B:
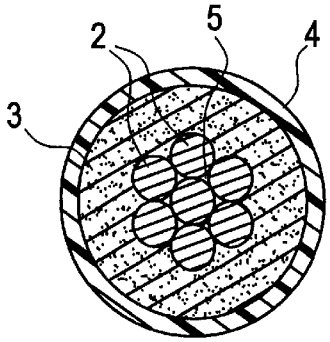
FIG. 1(B) is an enlarged cross sectional view along line A—A of FIG. 1(A)

FIG. 1A is a cross sectional view, partially broken, showing the conductor of the invention, and FIG. 1B is an enlarged cross sectional view seen from A—A of FIG. 1A.

As illustrated in the same, the conductor 1 is disposed at the center thereof with a core material composed of a plurality of twisted reinforcing fibers 2 and encircled with a metal matrix 3 therearound, and if required, further furnished with a coating layer 4 on the outer circumference of the metal matrix.

As the reinforcing fiber 2, metal fibers or organic fibers may be used other than carbon fibers or inorganic fibers such as ceramic fibers which have conventionally been used for reinforcing this kind of conductors. As to the diameter or the piece number of the reinforcing fiber 2, the larger the diameter or the more the piece number, the tensile strength becomes higher, but in contrast, the flexibility becomes lower, and when using the carbon fiber, ceramic fiber or organic fiber, since the electric conductivity goes down, the diameter or the piece number of the reinforcing fiber may be selected appropriately in response to a tensile strength and a flexibility to be aimed.

The metal matrix 3 where ceramic particles 3*a* as alumina particles as shown are dispersed in the metal 3*b*, may be used other than single metal such as copper, aluminum or these alloys. The metal matrix 3 dispersed with ceramic particles further improves the tensile strength of the conductor 1 due to synergistic effect in relation with the reinforcing fiber 2. As to the metal matrix 3, JP-A-8-109422 and JP-A-8-124426 may be referred to.

If the core material composed of the reinforcing fiber 2 is immersed in a liquid of melting the metal matrix 3, the core material can be encircled on the circumference with the metal matrix 3 as illustrated. When immersing, it is preferable to use a high pressure casting method, thereby enabling to form a thick metal matrix 3 on the circumference of the core material. An immersion method is simple in equipment comparing with other methods such as an extrusion method, and advantageously in manufacturing costs.

Figure 2A:
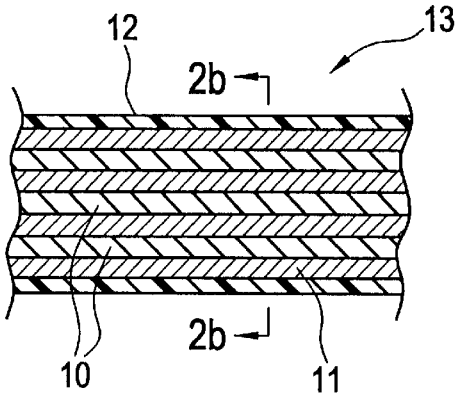
FIG. 2(a) PRIOR ART
FIG. 2(A) is a perspective view, partially broken, showing the flexible conductor of high strength and light weight of the prior art.
Figure 2B:
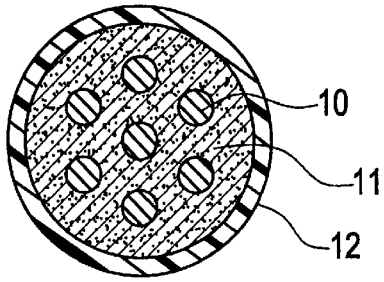
FIG. 2(b) PRIOR ART
FIG. 2(B) is an enlarged cross sectional view along a line B—B of FIG. 2(A).

In the conductor 1 composed as mentioned above, as shown in FIG. 1B, air spaces 5 are formed among the reinforcing fibers to form a core material in the lengthwise direction thereof, and since the reinforcing fibers 2 are twisted, the metal matrix 3 never goes into the air spaces. Therefore, each of the reinforcing fibers 3 slides one another following the bending of the conductor 1, and as shown in FIG. 2, each of the reinforcing fibers 10 is rich in flexibility in comparison with the conductor 13 encircled with the metal matrix 11. In particular, as the illustrated embodiment, when the center reinforcing fibers 2 are arranged around the circumference with other reinforcing fibers, the center reinforcing fibers 2 never contact the metal matrix 3 and may be freely moved among the other reinforcing fibers 2, so that the flexibility of the conductor 1 is further improved.

Furthermore, the reinforcing fibers 2 are twisted and disposed at the center of the conductor 1, and if the thickness of the metal matrix 3 is reduced for reducing the diameter of the conductor, the reinforcing fibers never appear in the surface of the metal matrix 3.

The conductor 1 of the invention is excellent in tensile strength and high in flexibility, and may be responsible to the reduction of the diameter.

The invention will be further explained by way of embodiments.

(Making of the conductor)

The core material composed by twisting 8000 pieces of the reinforcing fibers of diameter being 8 to 12 $\mu$m was immersed in a copper-molten liquid to produce the conductor A of diameter being 1 mm. The conductor B of the same diameter was immersed in the copper-molten liquid, not twisting the same fibers.

The bending characteristics of the conductor A and the conductor B were investigated. The testing methods were based on JIS Z 2248, and the bending moment was obtained by the forced load.

As testing results, assuming that the conductor A was 1, the bending moment of the conductor B was 0.8, and it was confirmed that the conductor A was excellent in the bending characteristic in comparison with the conductor B.

As mentioned above, since in the conductor of the invention, the core is composed by twisting the plurality of reinforcing fibers, the metal matrix does not invade into the air spaces formed among the reinforcing fibers, and when the conductor is bent, the reinforcing fibers slide one another to heighten the flexibility. Since the core material is positioned at the center of the conductor, if the thickness of the metal matrix is reduced for reducing the diameter of the conductor, the reinforcing fibers do not appear in the surface of the metal matrix. Besides, when using the metal matrix dispersed with ceramic particles together with the reinforcing fibers, the tensile strength can be further heightened.

What is claimed is:

1. A flexible conductor of high strength and light weight, comprising:

a core material including a plurality of twisted reinforcing fibers, and disposed at the center of the conductor; and a conductive metal matrix surrounding around the core material, wherein said plurality of twisted reinforcing fibers are in contact with each other such that air spaces are formed in a lengthwise direction interior to said plurality of twisted reinforcing fibers and said plurality of twisted reinforcing fibers impede said metal matrix from penetrating said Air spaces.

2. The flexible conductor of high strength and light weight as set forth in claim 1, the core material is defined by disposing at least one piece of reinforcing fiber at the center of the conductor and surrounding at least one piece of said reinforcing fiber by a plurality of reinforcing fibers so as to form the core material.

3. The flexible conductor of claim 1, wherein said reinforcing fibers are metal fibers.

4. The flexible conductor of claim 1, wherein said reinforcing fibers are organic fibers.

5. The flexible conductor of claim 1, wherein said metal matrix comprises a metal material having ceramic particles dispersed therein.

6. The flexible conductor of claim 1, wherein the metal matrix comprises a single metal material.

* * * * *